United States Patent [19]

Dahl et al.

[11] 4,300,714

[45] Nov. 17, 1981

[54] METHOD AND APPARATUS FOR SILENCING OF WEBS

[75] Inventors: Carl B. Dahl, Rockton, Ill.; Jere W. Crouse; Roy A. Langdon, both of Beloit, Wis.

[73] Assignee: Beloit Corporation, Beloit, Wis.

[21] Appl. No.: 113,235

[22] Filed: Jan. 17, 1980

[51] Int. Cl.[3] ..... B65H 23/04; G03B 1/48

[52] U.S. Cl. ..... 226/196; 226/97

[58] Field of Search ..... 226/95, 97, 197, 7, 226/196; 181/238, 239; 34/57 R, 57 A, 156; 271/97

[56] References Cited

U.S. PATENT DOCUMENTS

| | | | |
|---|---|---|---|
| 3,463,377 | 8/1969 | Lucas | 226/197 |
| 3,567,093 | 3/1971 | Johnson | 226/97 |
| 3,719,316 | 3/1973 | Frye | 226/97 |
| 4,176,775 | 12/1979 | Brendemuehl | 226/7 |

*Primary Examiner*—Leonard D. Christian

*Attorney, Agent, or Firm*—Hill, Van Santen, Steadman, Chiara & Simpson

[57] ABSTRACT

Noise-causing vibrations in the span of a tensioned web running over and away from an arcuate guide surface area of a circular perimeter fixed guide bar at a speed such that in the off-running angle between the web and the curved perimeter of the bar, air moving in the direction of the web in such angle would tend to follow the curvature of the bar (Coanda effect) and cause splitting of the air between the web and the bar, inhibited by locating spoiler means in a plane extending substantially tangentially from the off-running side of the arcuate guide surface area. The spoiler means is desirably in the form of one or more ribs providing surface in the tangential plane. Where the web span runs between spaced fixed circular perimeter bars, spoiler means may also be located in a plane extending substantially tangentially toward the on-running side of the arcuate guide surface of the bar located at the downstream end of the span.

16 Claims, 4 Drawing Figures

METHOD AND APPARATUS FOR SILENCING OF WEBS

This invention relates to the art of guiding tensioned running webs over fixed guide bars, and is more particularly concerned with elimination of vibrations which would cause noise in the running webs.

Where a web must run over a fixed guide bar, as for spreading a slit web or sheet between a slitter and a winder, and especially where the arcuate guide surface area of the bar which is wrapped by the web is provided with air lubrication, a high level of noise has been experienced. This has been traced to the web span moving away in downstream direction from the bar. By way of example, a web spreader or separator having spaced guide bars constructed and arranged for separating slit web strips and then orienting the strips in substantially parallel relation is represented in U.S. Pat. No. 3,463,377. It is the tensioned span between the bars where the noise-causing vibrations have been experienced.

Although the problem of noise-causing vibrations has been particularly noted in web separators or spreaders, the Coanda effect, that is the principle that air moving relative to a surface follows the surface even if curved, is present in any situation where a rapidly travelling web may be guided by a fixed guide bar of substantially circular perimeter.

It is to the alleviation of the described problem that the present invention is directed.

An important object of the invention is to inhibit noise-causing vibrations in web running over an arcuate guide surface area of a fixed guide bar of substantially circular perimeter.

Another object of the invention is to avoid the Coanda effect in any operations involving rapidly moving tensioned webs running over fixed guide bars of circular perimeter.

A further object of the invention is to inhibit noise-causing vibrations in the operation of web separators or spreaders.

The invention provides in a fixed guide bar of substantially circular perimeter providing an arcuate guide surface area over which a tensioned web is adapted to run at a speed such that in the off-running angle between the web and the curved perimeter of the bar, air moving in the direction of the web in such angle would tend to follow the curvature of the bar (Coanda effect) and cause splitting of the air between the web and the bar and thereby generate noise-causing vibration of the span of the web moving away from the bar, spoiler means located in a plane extending substantially tangentially from the off-running side of the arcuate guide surface area for avoiding the Coanda effect and for stabilizing air moving with the web and thereby inhibiting noise-causing vibrations of the span of the running web moving away from the bar.

The invention also provides a new and improved method of stabilizing air moving with the span of a tensioned rapidly running web moving away from an arcuate guide surface area of a fixed guide bar of substantially circular perimeter.

Other objects, features and advantages of the invention will be readily apparent from the following description of certain representative embodiments thereof, taken in conjunction with the accompanying drawing although variations and modifications may be effected without departing from the spirit and scope of the novel concepts embodied in the disclosure and in which.

Figure 1:
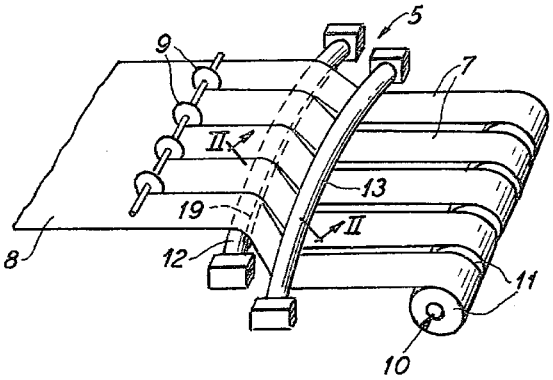
FIG. 1 is a schematic perspective view of a web separator or spreader embodying the invention.

By way of illustration of a practical embodiment of the present invention, a web separator or spreader 5 is depicted in FIG. 1. This is a device which has been found successful in practice for spreading a plurality of web strips 7 into which a wider web 8 such as paper has been slit as by means of slitters 9. The web 8 may come directly from a papermaking machine or stock roll (not shown), and the slit, spread strips or individual webs 7 are wound in a winder 10 into individual rolls 11.

In the spreader 5, the strip webs 7 run under tension and at a rapid speed across spaced fixed, i.e., non-rotating, bowed bars 12 and 13 of substantially circular perimeter, having the bow shape thereof and their spacing so related that as the slit separated webs 7 run over or wrap an arcuate guide surface area 14 of the first bar 12, the webs 7 are caused to spread a predetermined distance apart. Then as the spread webs 7 run in limited wrapping relation across an arcuate guide surface area 15 provided by the second bar 13, the webs 7 are caused to straighten and run in spaced parallel relation to the rolls 11. Air flotation support, bearing or lubrication of the webs 7 running across the guide areas 14 and 15 is effected by means of air supplied under suitable pressure through perforations 17 communicating between air pressure chamber 18 within the hollow interiors of the bars 12 and 13 and the guide surface areas 14 and 15. It will be understood, of course, that the perforations 17 are provided in an array extending throughout the effective lengths of the guide surfaces 14 and 15.

For avoiding the Coanda effect and for stabilizing air moving with the respective webs 7, and thereby inhibiting noise-causing vibrations of the respective spans of the running webs 7 moving away from the bar 12, spoiler surface means 19 are located in a plane extending substantially tangentially from the off-running side of the arcuate guide surface area 14. In a convenient form, the spoiler means 19 comprises a rib structure extending along the effective length of the off-running side of the area 14. A generally obtuse triangular transverse cross-sectional shape for the spoiler rib 19 wherein the hypotenuse lies on the perimeter of the bar 12 has been found suitable. An elongate flat face 20 of the rib 19 lies on a tangent to the surface area 14 and parallel to the off-running span of the respective webs 7. At its remaining face which is directed downstream relative to the area 14, the rib 19 drops off angularly away from the face 20. While the rib 19 may be formed as an integral part of the bar 12, it may, as shown, be formed separately and attached to the bar 12 in any suitable manner, such as by welding, brazing, screwing on, epoxy bonding, or the like. Although the rib 19 may be in the form of a continuous bar-like element, it may comprise a series of sections extending end-to-end.

As a result of the spoiler surface means rib 19, air moving in the running direction of the web 7 is stabilized and caused to move with the web in the off-running angle A between the web and the curved perimeter of the bar 12. In the absence of the spoiler ribs 19, the air moving in the direction of the web 7 in the off-running angle A would tend to follow the curvature of the bar (Coanda effect) and cause splitting of the air between the web and the bar and thereby generate noise-causing vibration of the span of the web moving away from the bar. The spoiler rib 19 prevents the air which exits from the area 14 from following the curved surface of the bar 12 and controllably forces the air to follow the web 7. This arrangement also cooperates with the air cushion or lubricating means including the ports 17 to extend the supporting dynamic air cushion for the web 7 beyond the wrap or guide area 14. Since the Coanda effect is thus avoided, there is no tendency for the web 7 to be drawn toward or collapse toward the perimeter of the bar 12 beyond the supporting, lubricating, air cushion effect over the guide surface 14, and the web 7 moves on relatively smoothly and substantially free from at least objectionable noise-causing vibrations.

Efficiency of the noise-causing-vibration inhibiting effect is even further improved by equipping the downstream bar 13 of the spreader 5 with spoiler means 21 which desirably comprises a rib structure similar to the rib structure 19, but located at the on-running side of the arcuate guide surface area 15. The rib 21 may be of the same structure as the rib 19 and attached to the bar 13 in substantially the same manner. The cross-sectional shape of the rib 21 may be substantially the same as the rib 19, having a face 22 which has its surface plane substantially tangential to the on-running side of the area 15. This prevents air from the web supporting, lubricating, cushioning layer between the web 7 and the bar surface 15 from tending to leak along the circular perimeter of the bar 13 and away from the on-running web 7. As a result of the rib surface 22, the air cushion layer is extended to the on-running side of the area 15 for smooth running of the web 7 toward and then in its wrap over the guide area 15.

Figure 3:
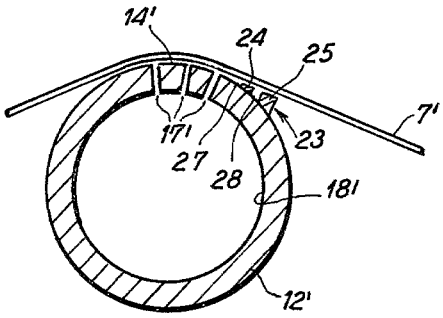
FIG. 3 is a sectional detail view showing a modification.
Figure 2:
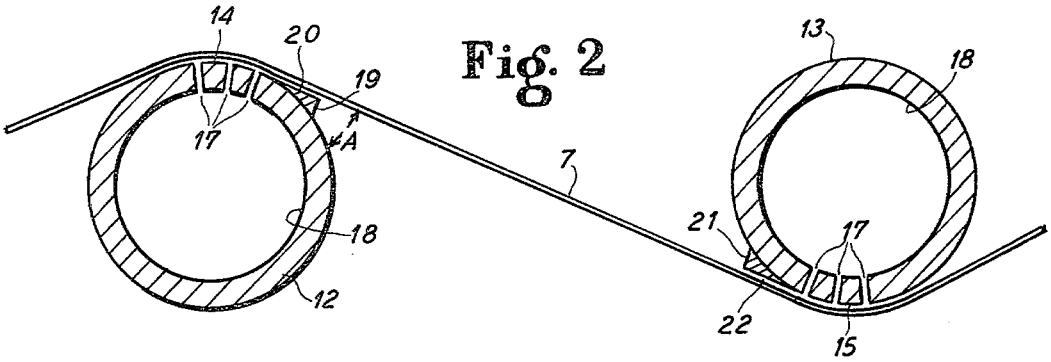
FIG. 2 is an enlarged fragmentary sectional detail view taken substantially along the line II—II of FIG. 1.

Instead of a solid surfaced spoiler rib structure as at 19 or 21, spoiler surface means 23 (FIG. 3) in the form of a plurality, herein two adjacently spaced rib elements 24 and 25 of progressively greater height and having their crowns in a common plane tangent to the arcuate guide surface area 14' may be employed on the substantially circular perimeter bar 12' which is provided with lubricating air cushion means comprising the array of orifices 17' delivering air under pressure from the chamber 18' to the area 14'. It will be understood that the rib elements 24 and 25 also desirably extend the full length of the effective length of the area 14'. Elongate air pockets 27 and 28 upstream respectively along the rib element 24 and the rib element 25 tend to catch and build up limited air pressure providing limited lift to the web 7' on the off-running side of the area 14'. Under certain conditions, such lift further assists in subduing or inhibiting noise-causing vibrations of the span of the running web moving away from the bar 12'.

Figure 4:
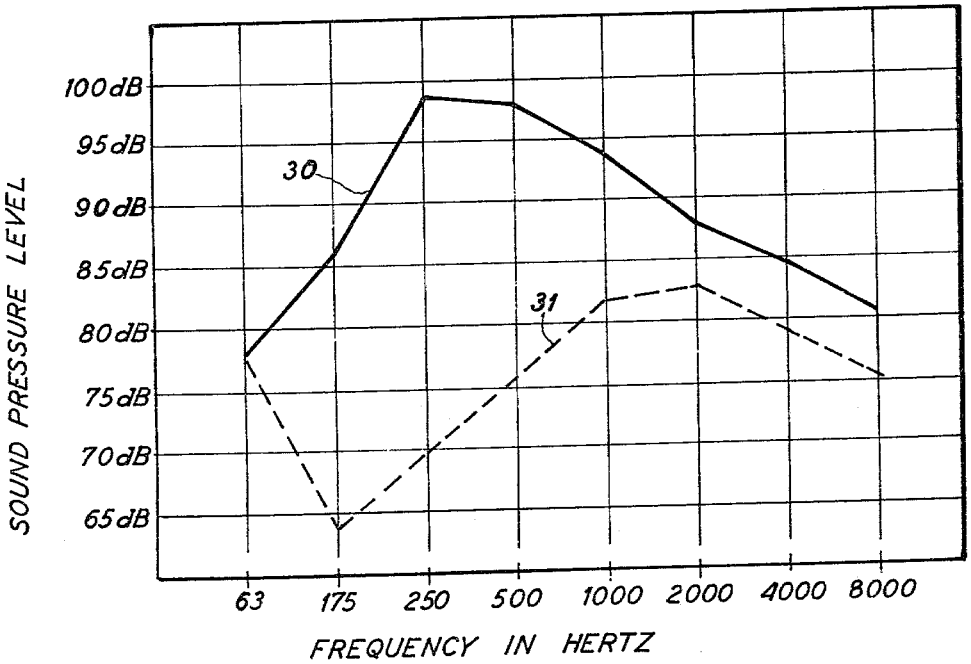
FIG. 4 is an analysis chart demonstrating the substantial noise level reduction attainable with the present invention.

By way of graphically demonstrating the substantially new and improved results attainable by the present invention, FIG. 4 shows graphically how noise has been reduced by the present invention as compared to identical operation without the present invention. That is, in FIG. 4, a solid curve 30 represents sound level in a spreader installation not equipped with spoiler means according to the present invention, and the dash line curve 31 illustrates the subdued noise level in the same or identical apparatus embodying the present invention. In running the test in both instances, paper web travelling at an identical speed under tension of four pounds per linear inch was tested with the same noise meter starting at a hertz frequency of 63 at which the decibel or sound pressure level was under 80. At the 175 hertz frequency, the curve 30 showed a jump to above the 85 decibel level whereas the curve 31 showed a dramatic drop to below the 65 decibel level. From the 175 hertz frequency to the 250 hertz frequency test point, there was only a slight increase to about the 70 decibel level for the curve 31 which increased slowly to the 1,000 hertz frequency and then substantially plateaued to 2,000 hertz and then dropped off through the 4,000 and 8,000 hertz test points. At no hertz frequency test point did the curve 31 reach the 85 decibel level. On the other hand, the curve 30 continued sharply up to close to the 100 decibel level at 250 hertz frequency and then only gradually dropped off to the 8,000 hertz frequency and at all times well above the hertz frequency test points for the curve 31. These test results hold true to the highest speeds at which the web may safely be run.

It will be understood that variations and modifications may be effected without departing from the spirit and scope of the novel concepts of this invention.

We claim as our invention:

1. In a fixed guide bar of substantially circular perimeter providing an arcuate guide surface area over which a tensioned web is adapted to run at a speed such that in the off-running angle between the web and the curved perimeter of the bar, air moving in the direction of the web in such angle would tend to follow the curvature of the bar (Coanda effect) and cause splitting of the air between the web and the bar and thereby generate noise-causing vibration of the span of the web moving away from the bar, the improvement comprising:

spoiler surface means located along the effective length of said guide surface area, and said spoiler surface means lying in a plane extending substantially tangentially from the off-running side of said arcuate guide surface area for avoiding the Coanda effect and for stabilizing air moving with the web and thereby inhibiting noise-causing vibrations of said span of the running web moving away from the bar.

2. A guide bar and spoiler means according to claim 1, wherein the spoiler surface means comprises a rib on the bar.

3. A guide bar and spoiler means according to claim 2, wherein said rib is of substantially triangular transverse cross-section and has a face providing said spoiler surface means in said plane extending substantially tangentially from the off-running side of said arcuate guide surface area.

4. A guide bar and spoiler means according to claim 1, wherein said spoiler surface means comprises a plurality of rib elements located in adjacently spaced relation and extending along the effective length of said guide surface area.

5. A guide bar and spoiler means according to claim 4, wherein said ribs have crown surfaces lying in said plane extending substantially tangentially from the off-running side of said arcuate guide surface area.

6. A guide bar and spoiler means according to claim 1, including means for supplying lubricating air cushion between said guide surface area and the web and between the spoiler surface means and the web.

7. In combination, a first fixed guide bar of substantially circular perimeter providing an arcuate guide surface area over which a tensioned web is adapted to run at a speed such that in the off-running angle between the web and the curved perimeter of the first bar, air moving in the direction of the web in such angle would tend to follow the curvature of the first bar (Coanda effect) and cause splitting of the air between the web and the first bar and thereby generate noise-causing vibration of the span of the web moving away from the first bar, and a second fixed guide bar of substantially circular perimeter spaced downstream from said first fixed guide bar and also having an arcuate guide surface area across which the web is adapted to run at the downstream end of said span, the improvement comprising:

spoiler means located in a plane extending substantially tangentially from the off-running side of said arcuate guide surface area for avoiding the Coanda effect and for stabilizing air moving with the web and thereby inhibiting noise-causing vibrations of said span of the running web moving away from the first bar;

and spoiler means located in a plane extending substantially tangentially topward the on-running side of said arcuate guide surface area of said second guide bar and cooperating with the spoiler means of said first guide bar for stabilizing air moving with the web toward said guide surface area of the second bar.

8. A combination according to claim 7, wherein said spoiler means in the on-running angle between the web and the curved perimeter of the second bar comprises a rib having a face in said plane extending substantially tangentially toward the on-running side of said arcuate guide surface area of said second bar.

9. In a method of inhibiting noise-causing vibrations in the span of a tensioned web running over and away from an arcuate guide surface area of a circular perimeter fixed guide bar at a speed such that in the off-running angle between the web and the curved perimeter of the bar, air moving in the direction of the web in such angle would tend to follow the curvature of the bar (Coanda effect) and cause splitting of the air between the web and the bar and thereby generate noise-causing vibration of said span of the web, the improvement comprising:

locating spoiler surface means along the effective length of said guide surface area, and said spoiler surface means lying in a plane extending substantially tangentially from the off-running side of said arcuate guide surface area, and thereby avoiding the Coanda effect, and stabilizing the air moving with the web and inhibiting noise-causing vibrations of said span of the running web moving away from the bar.

10. A method according to claim 9, which comprises providing said spoiler surface means in the form of a rib on said bar.

11. A method according to claim 10, which comprises providing said rib of substantially triangular transverse cross-section and locating a face providing said spoiler surface means on said rib in said plane extending substantially tangentially from the off-running side of said arcuate guide surface area.

12. A method according to claim 9, which comprises locating a plurality of rib elements in adjacently spaced relation extending along the effective length of said guide surface area to provide said spoiler surface means.

13. A method according to claim 12, comprising providing said ribs with crown surfaces and locating said crown surfaces in said plane extending substantially tangentially from the off-running side of said arcuate guide surface area.

14. A method according to claim 9, including supplying lubricating air cushion between said guide surface area and the web and between said spoiler surface means and said web.

15. In a method of inhibiting noise-causing vibrations in the span of a tensioned web running over and away from an arcuate guide surface area of a circular perimeter first fixed guide bar at a speed such that in the off-running angle between the web and the curved perimeter of the first bar, air moving in the direction of the web in such angle would tend to follow the curvature of the bar (Coanda effect) and cause splitting of the air between the web and the first bar and thereby generate noise-causing vibration of said span of the web, and a second fixed guide bar of substantially circular perimeter spaced downstream from said first fixed guide bar and also having an arcuate guide surface area across which the web runs at the downstream end of said span, the improvement comprising:

locating spoiler means in a plane extending substantially tangentially from the off-running side of said arcuate guide surface area of said first bar, and thereby avoiding the Coanda effect, and stabilizing the air moving with the web and inhibiting noise-causing vibrations of said span of the running web moving away from the first bar;

and locating spoiler means in a plane extending substantially tangentially toward the on-running side of said arcuate surface area of said second guide bar and cooperating with the spoiler means of said first guide bar and thereby stabilizing air moving with the web toward said guide surface area of the second bar.

16. A method according to claim 15, which comprises providing said spoiler means in the on-running angle between the web and the curved perimeter of the second bar in the form of a rib and locating a face of said rib in said plane extending substantially tangentially toward the on-running side of said arcuate guide surface area of said second bar.

* * * * *